US006565391B2

(12) United States Patent
Bernstein et al.

(10) Patent No.: US 6,565,391 B2
(45) Date of Patent: May 20, 2003

(54) HIGH DENSITY RJ CONNECTOR ASSEMBLY

(76) Inventors: Elliot Bernstein, deceased, late of Glen Cove, NY (US); by Sybil Bernstein, executor, Ridge Rd., Glen Cove, NY (US) 11542; John Chen, 321 Sunstream Ct., Danville, CA (US) 94526

( * ) Notice: Subject to any disclaimer, the term of this patent is extended or adjusted under 35 U.S.C. 154(b) by 0 days.

(21) Appl. No.: 09/954,583

(22) Filed: Sep. 17, 2001

(65) Prior Publication Data

US 2002/0090862 A1 Jul. 11, 2002

Related U.S. Application Data

(60) Provisional application No. 60/233,361, filed on Sep. 18, 2000.

(51) Int. Cl.[7] ..... H01R 13/514
(52) U.S. Cl. ..... 439/701; 439/676
(58) Field of Search ..... 439/701, 76.1, 439/676, 620

(56) References Cited

U.S. PATENT DOCUMENTS 4,878,848 A * 11/1989 Ingalsbe ..... 439/76.1
5,639,267 A * 6/1997 Loudermilk ..... 439/701

* cited by examiner

*Primary Examiner*—Renee Luebke
*Assistant Examiner*—Ann McCamey
(74) *Attorney, Agent, or Firm*—Ostrolenk, Faber, Gerb & Soffen, LLP

(57) ABSTRACT

A modular connector having a housing with one or more compartments, each compartment being structured and arranged to receive a plug. Within the housing are one or more conductive planes. Preferably, there are two conductive planes, a voltage source plane and a voltage ground plane. These source and ground planes are provided on a printed circuit board within the housing. The source and ground planes create a low impedance path for the source and ground connections by directly connecting the source and ground planes to a system printed circuit board of the equipment unit by a common voltage source pin and a common voltage ground pin, each of which extend from the housing. The voltage source connections and the voltage ground connections for each RJ jack are respectively connected to the voltage source plane and the voltage ground plane such that each of the RJ jacks share a common voltage source and ground. Accordingly, when multiport RJ connectors are formed, the use of the common source and ground planes operates to reduce the number of pins in each RJ unit by requiring only one voltage source pin and one voltage ground pin regardless of the number of RJ jacks in the multiport connector.

9 Claims, 2 Drawing Sheets

HIGH DENSITY RJ CONNECTOR ASSEMBLY

CROSS REFERENCE TO RELATED APPLICATION

This application claims the benefit and priority of U.S. Provisional Application Ser. No. 60/233,361 filed Sep. 18, 2000 entitled "HIGH DENSITY RJ CONNECTOR ASSEMBLY" the disclosure of which is incorporated by reference.

BACKGROUND OF THE INVENTION

The present invention relates to RJ connectors and, in particular, to a multiport RJ connector which reduced short-out possibilities in the connector and simplifies the routing of conductive paths on a PC board.

RJ connectors are modular connectors used in telecommunications and data networks to interconnect equipment units. As the need for speed of such equipment increases, the frequencies of the signals employed in such equipment also increase (i.e., into the gigahertz range). At the same time, there is a need to make the equipment more compact. The use of high frequencies combined with the increased compactness of the equipment leads to increased problems of unwanted interactions between signals carried by the connectors.

Further, when these high frequency connectors are arranged into a multiport connector assembly, the RJ jacks which are located furthest from the system printed circuit board are required to have multiple long lead length conductors of relatively high impedance such that the high end frequencies may be conducted without a substantial amount of interference. The use of these long lead length conductors further complicates the routing and placement of the conductors within the RJ unit.

Accordingly, there remains a need for an RJ connector which provides a direct and low impedance path for ground and or source connections to the system printed circuit board.

SUMMARY OF THE INVENTION

Accordingly, it is an object of the present invention to provide a more compact arrangement of RJ connectors and, more particularly, to provide a multiport RJ connector having a direct and low impedance path for ground and source connections to the system printed circuit board.

The invention provides a modular connector which includes a direct and low impedance path for the ground and source connections to the system printed circuit board. The modular connector includes a housing with one or more compartments, each compartment being structured and arranged to receive a plug. Within the housing are one or more conductive planes. Preferably, there are two conductive planes, a voltage source plane and a voltage ground plane. These source and ground planes are provided on a printed circuit board within the housing. The source and ground planes create a low impedance path for the source and ground connections by directly connecting the source and ground planes to the system printed circuit board of the equipment unit by a common voltage source pin and a common voltage ground pin, each of which extend from the housing. The voltage source connections and the voltage ground connections for each RJ jack are respectively connected to the voltage source plane and the voltage ground plane such that each of the RJ jacks share a common voltage source and ground. Accordingly, when multiport RJ connectors are formed, the use of the common source and ground planes operates to reduce the number of pins in each RJ unit by requiring only one voltage source pin and one voltage ground pin regardless of the number of RJ jacks in the multiport connector.

BRIEF DESCRIPTION OF THE DRAWINGS

Other features and advantages of the present invention will become apparent from the following description of the invention which refers to the accompanying drawings, wherein.

DETAILED DESCRIPTION OF EMBODIMENTS OF THE INVENTION

Figure 1:
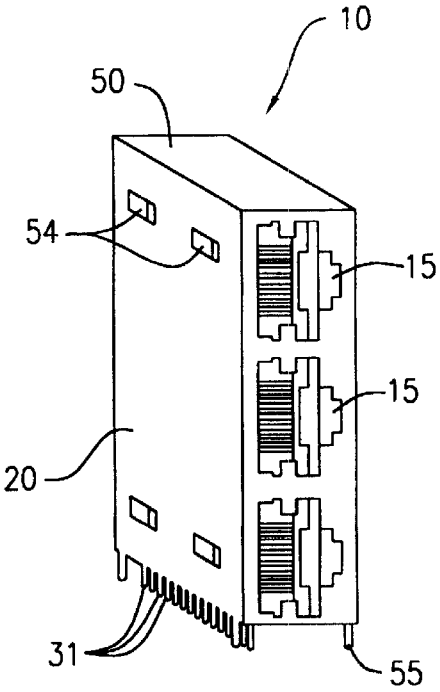
FIG. 1 is a left side perspective view of a multiport modular connector unit in accordance with one embodiment of the present invention.
Figure 2:
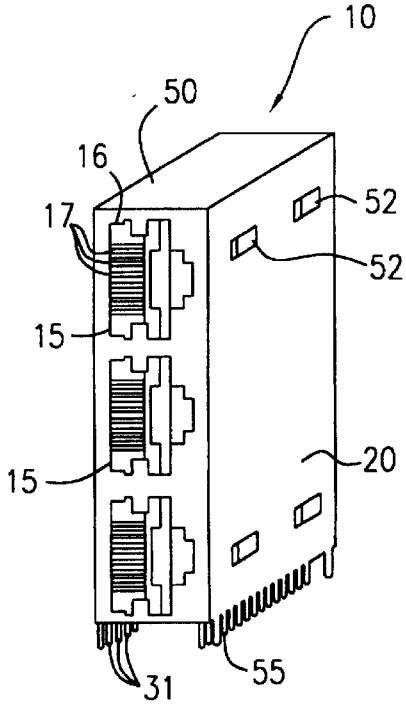
FIG. 2 is a right side perspective view of the multiport modular connector unit of FIG. 1.
Figure 3:
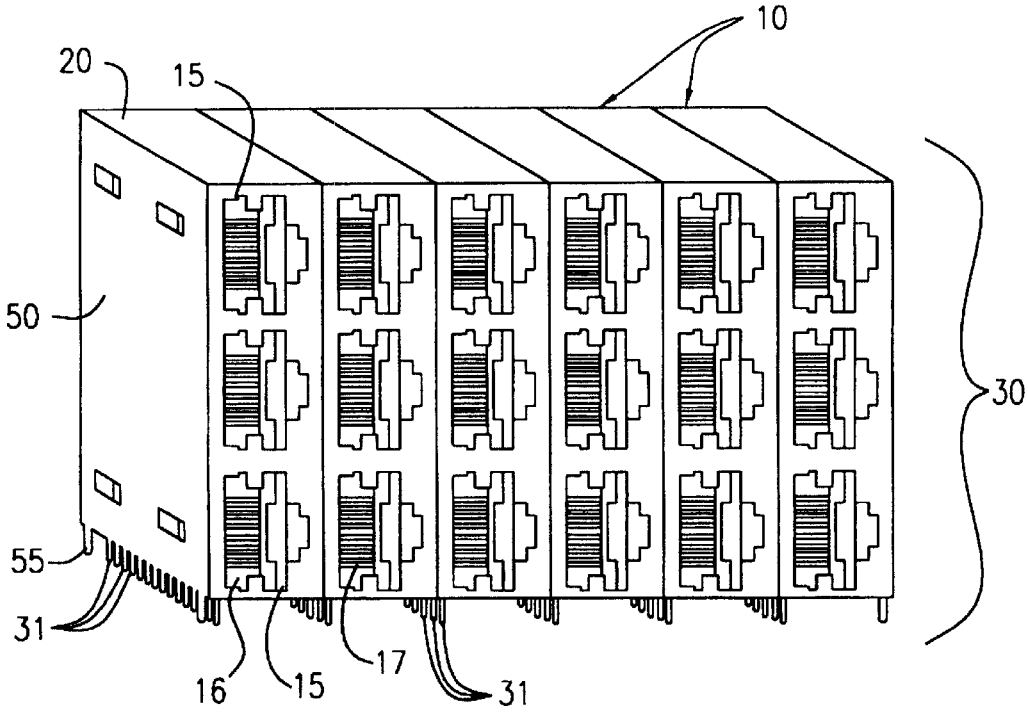
FIG. 3 is a left side perspective view of a multiport modular connector assembly in accordance with one embodiment of the present invention.

Referring now to the drawings, FIGS. 1 and 2 show individual RJ connector units 10, which may incorporate a plurality of RJ jacks 15, such as those disclosed in U.S. application Ser. No. 09/492,895 ("the '895 application"), filed Jan. 27, 2000, entitled "RJ Jack With Integrated Interface Magnetics", the entire disclosure of which is incorporated by reference herein.

Each RJ unit 10 includes a housing 20 which accommodates the RJ jacks 15. Each of the RJ jacks 15 comprise a compartment 16 which is structured and arranged to receive a plug (not shown). The plug is used to transport signals between various equipment units. Within the compartment 16 is a plurality of conductive contact fingers 17. Each of the contact fingers 17 have a first portion which makes electrical contact with the plug and a second portion which makes electrical contact with signal pins 31 which extend from the housing 20. These signal pins 31 are arranged such that they can be connected to a system printed circuit board (not shown) within the equipment units.

Conventional RJ jacks normally have eight signal pins per jack (five signal pins, a voltage source pin, a voltage ground pin and a chassis ground pin). Therefore, a conventional RJ unit having three vertically stacked RJ jacks would normally have a total of 24 pins (i.e., three RJ jacks×eight pins per jack=24 pins). However, the connector of the '895 application (incorporated herein by reference above) normally only has six pins per jack. Accordingly, if an RJ unit having three vertically stacked RJ jacks were manufactured according to the teachings of the '895 application, the number of pins per RJ unit would be reduced to a total of 18 pins.

Figure 5:
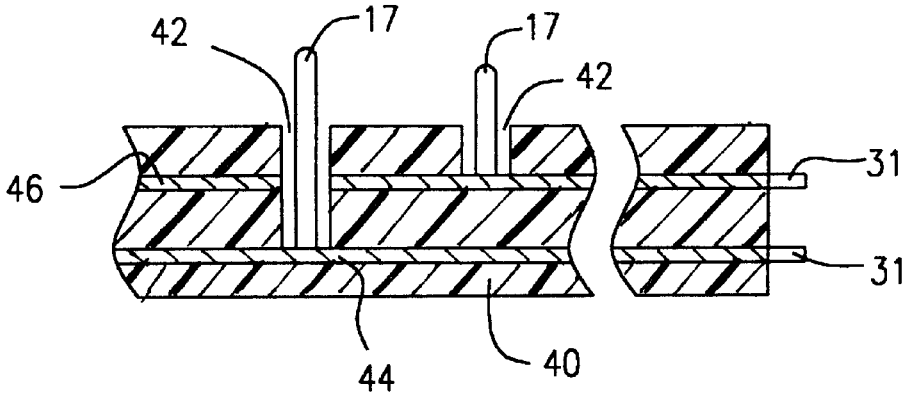
FIG. 5 is a cross-section of the printed circuit board of FIG. 4.
Figure 4:
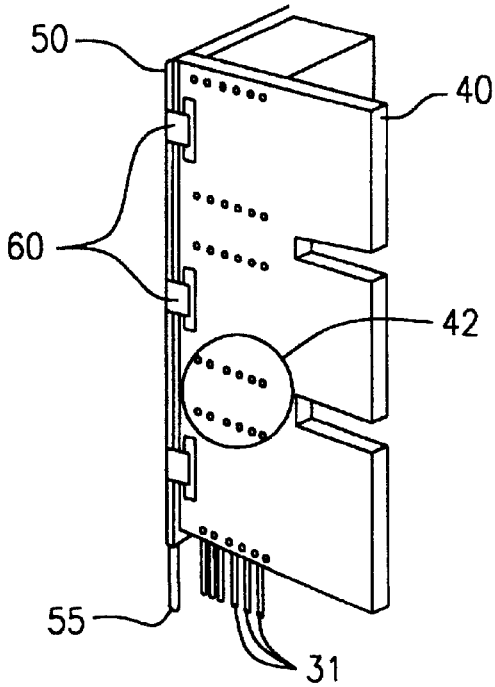
FIG. 4 shows one embodiment of the printed circuit board of the present invention having the voltage source and ground planes.

As shown in FIGS. 4 and 5, however, the present design further reduces the number of pins by providing one or more voltage source (V+) 44 and voltage ground (G) 46 planes in each RJ unit 10. These source 44 and ground 46 planes are provided on a printed circuit board 40 which is included within the housing 20. For each RJ jack 15, one conductive contact finger of the plurality of contact fingers 17 has its second end connected to the voltage source plane 44 of the printed circuit board 40, and a second conductive contact finger of the plurality of contact fingers 17 has its second end connected to the ground plane 46 of the printed circuit board 40. Preferably, and as shown in FIGS. 4 and 5, the second ends of the contact fingers are connected to the voltage source 44 and voltage ground 46 planes through internal connections 42 within the printed circuit board 40. These internal connections are preferably center taps within the printed circuit board 40 to the source 44 and ground 46 planes and/or individual connections to the source 44 and ground 46 planes.

Although FIG. 4 shows the printed circuit board 40 provided at the side of the RJ unit 10 in a vertical orientation, many other placements of the printed circuit board are contemplated, such as, for example, a top, back, bottom or middle mounted printed circuit board.

The use of the printed circuit board 40 with a source 44 and ground 46 plane provides a low impedance path for the source and/or ground connections even with the use of frequencies in the gigahertz range. To provide this low impedance path, the voltage source 44 and ground 46 planes can be connected directly to the system printed circuit board of the equipment unit (not shown) by a common voltage source pin 31 and a common voltage ground pin 31 which extend from the housing 20. Also, the low impedance path for the voltage ground plane 46 can be connected to a metal shield 50 provided around the housing, which will be described in greater detail below. Accordingly, the use of voltage source 44 and ground 46 planes on a printed circuit board 40 within the connector housing 20 provides a direct and low impedance path for the ground and source connections to the system printed circuit board and eliminates the need for multiple long lead length conductors of relatively high impedance for use with high end frequencies.

In other words, the source 44 and ground 46 planes enable the voltage source and ground fingers of each RJ jack 15 to be connected to a common plane within the RJ unit 10 and exit the RJ unit 10 as a common source and ground pin for all RJ jacks 15 within the RJ unit 10. Also, the use of the common source 44 and ground 46 planes further reduces the number of pins in each RJ unit 10 from eighteen to fifteen for the RJ unit 10 shown in FIGS. 1 and 2 (i.e., one chassis ground, 12 signal pins (four signal pins for each RJ Jack× three RJ jacks), one voltage source pin and one voltage ground pin).

Further, the use of a common source plane 44 and a common ground plane 46 allows for the increase of spacing between the holes on the system printed circuit board (not shown) without an increase in the dimensions of the housing. This increasing of spacing between the pins 31 reduces the possibility of short-outs and cross-talk between adjacent pins 31 of the RJ unit 10.

Also, the use of common source 44 and ground 46 planes simplifies the routing of conductive paths within the RJ unit 10. Because the common source 44 and ground 46 planes only need to exit the housing 20 from one location, each source and ground finger of each RJ jack 15 does not need to be routed separately through the housing to a respective pin. Accordingly, the cross-talk within the RJ unit 10 itself is also reduced.

As stated above, and shown in FIGS. 1–4, the housings 20 of each RJ unit 10 may also be covered with a metal shield 50. The metal shields 50 of each housing 20 are preferably designed to snap together with each other so as to form an RJ connector assembly 30 such as that shown in FIG. 3. To secure the metal shields 50 each RJ unit 10 together, opposite sides of the metal shield 50 are provided with either clips 52 (FIG. 2) or loops 54 (FIG. 1). Accordingly, each of the metal shields 50 can easily be attached together by sliding the clips 52 into respective loops 54 on an adjacent metal shield of a similar RJ unit 10. Although FIGS. 1 and 2 show four loops 54 and four clips 52, respectively, any desired number of clips and loops may be used, the number depending upon, for example, the size of the RJ unit 10.

The metal shield 50 also preferably includes a grounding tab 55. The grounding tab 55 is preferably connected to a chassis ground within the equipment unit (not shown). The use of the metal shield 50, and the grounding of the metal shield to the chassis ground, assists in reducing the effects of electromagnetic interference within the RJ unit 10. Further, and as shown in FIG. 4, the ground plane of the printed circuit board 40 can be connected to the metal shield 50 by connections 60 and grounded together therewith via the metal shield grounding tab 55 so as to further reduce the number of pins required for the RJ unit 10.

Because the metal shields 50 of the RJ units 10 are easily attachable together, any combination of 2×8, 4×10 or 3×6 (the combination shown in FIG. 3) may be formed by varying the number of RJ jacks 15 in the vertical and horizontal planes of each RJ unit 10.

Although the figures show a connector assembly wherein the RJ jacks are aligned in a vertical orientation, it will be evident that the RJ units and resultant connector assemblies may take many different shapes and forms. For example, the RJ units and jacks can be aligned in a horizontal orientation. Moreover, with the assembly 30 shown in shown in FIG. 3, if desired, a printed circuit board 40 having a common voltage source plane 44 and a common voltage ground plane 46 may be used for the entire assembly 30 such that only a single voltage pin and ground pin are needed all RJ jacks in the entire assembly. Further, even though multiple RJ jacks are shown, the concept of utilizing voltage source and ground planes on a printed circuit board can be applied to a single jack construction.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A modular connector, which comprises:

a housing having at least two aligned compartments, each compartment being structured and arranged to receive respective plugs;

a first conductive plane within the housing;

a second conductive plane within the housing;

a first plurality of conductive contact fingers in one of the compartments, each of the first plurality of fingers having first portions for making electrical contact with one of the plugs, one finger of the plurality of first fingers having a second portion for making contact with the first conductive plane and another one of the plurality of first fingers having a second portion for making contact with the second conductive plane; and a second plurality of conductive contact fingers in the other of the compartments, each of the second plurality of fingers having first portions for making electrical contact with another one of the plugs, one finger of the plurality of second fingers having a second portion for making contact with the first conductive plane and another one of the plurality of second fingers having a second portion for making contact with the second conductive plane;

wherein the first conductive plane and the second conductive plane are provided on a printed circuit board within the housing.

2. The modular connector according to claim 1, further comprising:

a first signal pin extending from the housing, the first signal pin being connected to the first conductive plane; and a second signal pin extending from the housing, the second signal pin being connected to the second conductive plane.

3. The modular connector according to claim 1, wherein the first conductive plane is a ground plane.

4. The modular connector according to claim 3, wherein the second conductive plane is a voltage source plane.

5. The modular connector according to claim 1, further comprising a metal shield surrounding the housing.

6. The modular connector according to claim 5, wherein the metal shield includes connecting elements on an outer surface thereof, the connecting elements facilitating connection of the metal shield surrounding the housing to another metal shield.

7. The modular connector according to claim 6, wherein the connecting elements are provided on opposite first and second sides of the metal shield surrounding the housing.

8. The modular connector according to claim 7, wherein the connecting elements on the first side of the metal shield are clips and the connecting elements on the second side of the metal shield are loops.

9. The modular connector according to claim 8, wherein the metal shield is connected to the first conductive plane.

* * * * *